US006443514B1

(12) United States Patent
Fuller et al.

(10) Patent No.: US 6,443,514 B1
(45) Date of Patent: Sep. 3, 2002

(54) HOIST RING

(75) Inventors: Harry Fuller, Newbury; James C. Klingenburg, Concord, both of OH (US)

(73) Assignee: Jergens, Inc., Cleveland, OH (US)

( * ) Notice: Subject to any disclaimer, the term of this patent is extended or adjusted under 35 U.S.C. 154(b) by 0 days.

(21) Appl. No.: 09/953,600

(22) Filed: Sep. 17, 2001

(51) Int. Cl.[7] ..... B66C 1/66
(52) U.S. Cl. ..... 294/1.1; 294/89; 403/78
(58) Field of Search ..... 294/1.1, 82.1, 294/89; 243/499; 403/78, 79, 119, 164; 410/101, 104, 111; 411/400

(56) References Cited

U.S. PATENT DOCUMENTS

| | | | | |
|---|---|---|---|---|
| 3,297,293 | A | | 1/1967 | Andrews et al. |
| 3,371,951 | A | | 3/1968 | Bryant |
| 3,492,033 | A | | 1/1970 | Mueller |
| 3,628,820 | A | | 12/1971 | Blatt |
| 3,905,633 | A | | 9/1975 | Larson |
| 4,074,519 | A | | 2/1978 | Garrett |
| 4,431,352 | A | | 2/1984 | Andrews |
| 4,557,513 | A | | 12/1985 | Ferrieri |
| 4,558,979 | A | | 12/1985 | Andrews |
| 4,570,987 | A | | 2/1986 | Wong et al. |
| 4,592,686 | A | | 6/1986 | Andrews |
| 4,641,986 | A | | 2/1987 | Tsui et al. |
| 4,699,410 | A | | 10/1987 | Seidel |
| 4,705,422 | A | | 11/1987 | Tsui et al. |
| 5,125,861 | A | | 6/1992 | Freeman |
| 5,183,360 | A | | 2/1993 | Freeman |
| 5,248,176 | A | | 9/1993 | Fredriksson |
| 5,286,130 | A | | 2/1994 | Mueller |
| 5,352,056 | A | | 10/1994 | Chandler |
| 5,586,801 | A | | 12/1996 | Sawyer et al. |
| 5,634,734 | A | | 6/1997 | Schron, Jr. et al. |
| 5,743,576 | A | | 4/1998 | Schron, Jr. et al. |
| 5,775,664 | A | | 7/1998 | Martin |
| D409,895 | S | | 5/1999 | Schron, Jr. et al. |
| 6,032,993 | A | | 3/2000 | Kwon |
| 6,039,500 | A | * | 3/2000 | Kwon ..... 294/1.1 X |
| 6,068,310 | A | | 5/2000 | Fuller et al. |
| 6,267,422 | B1 | * | 7/2001 | Alba ..... 294/1.1 |
| 6,293,600 | B1 | | 9/2001 | Lecourt |

FOREIGN PATENT DOCUMENTS

| | | |
|---|---|---|
| EP | 0 365 430 | 4/1990 |

* cited by examiner

*Primary Examiner*—Johnny D. Cherry
(74) *Attorney, Agent, or Firm*—Vickers, Daniels & Young

(57) ABSTRACT

A hoist ring for fixed engagement, in a mounted position, in a threaded bore on a load surface of a load member includes a load bearing ring, a support member and a post. The support member has a cylindrical passage having a first axis and further includes a ring slot to pivotally support the load ring and allow the load ring to rotate about a second axis perpendicular to the first axis such that the load ring freely adjusts to the direction of an applied force. The post has an unthreaded portion in the passage and the passage and the ring slot intersect for the unthreaded, portion of the post to interengage with the load ring to retain the load ring in the ring slot when the post is received in the passage.

18 Claims, 2 Drawing Sheets

FIG. 3
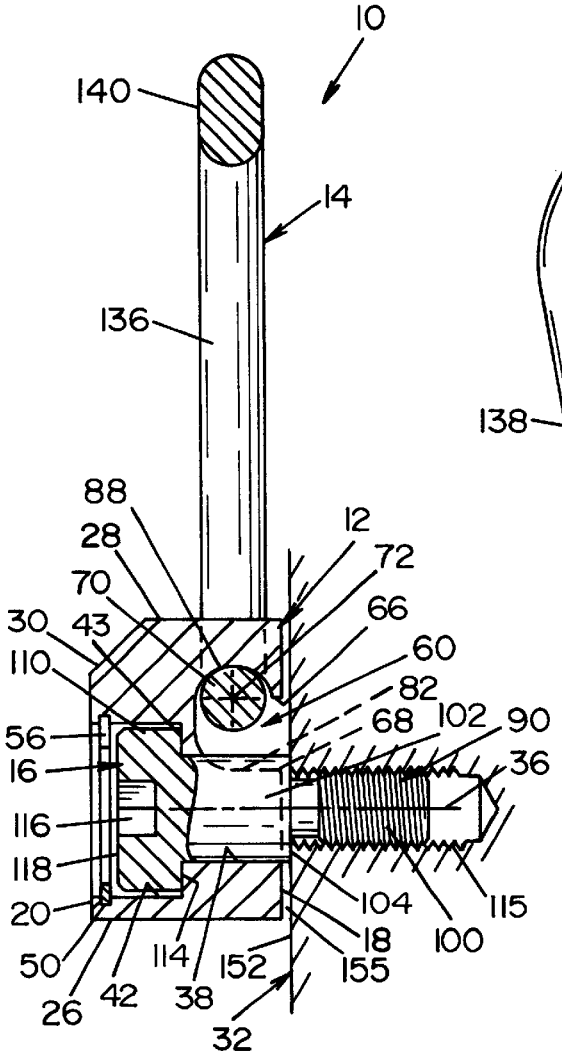
FIG. 4
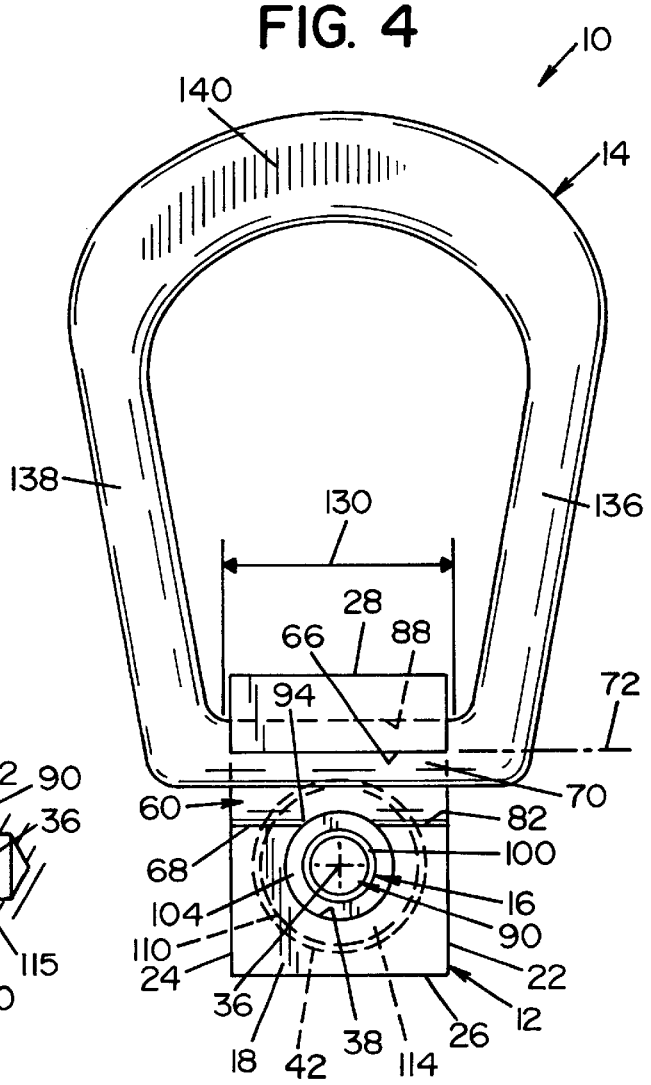
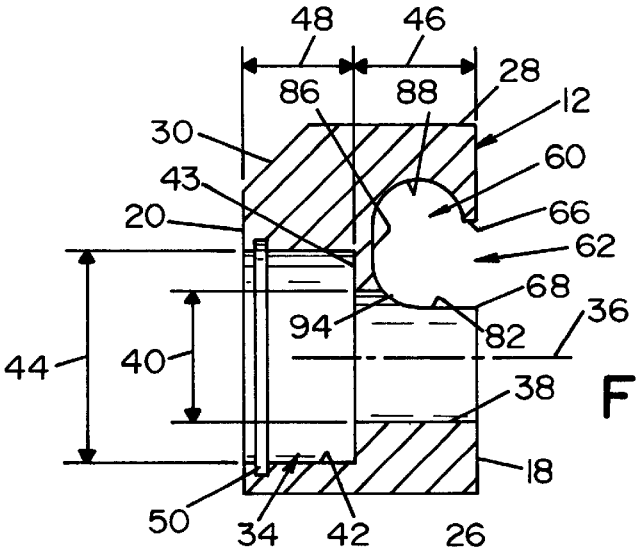
FIG. 5

HOIST RING

It is well known in the art that connecting a ring to a load member can be utilized to lift and manipulate the load member such as die sets or molds. Further, it is well known that a ring attached to a load member can be used to secure the load member such as for transportation of the load member. Fuller U.S. Pat. No. 6,068,310, for example, discloses a side-pull style hoist ring which pivotally secures a load bearing ring to a load member and is incorporated by reference herein as background information for side-pull hoist rings.

Another style of hoist rings which is utilized to lift or secure a load member is disclosed in Schron, Jr. U.S. Pat. No. 5,634,734 and U.S. Pat. No. 5,743,576. The patents to Schron Jr. disclose a center-pull style hoist ring which also fastens a load bearing ring to a load member. As with the side-pull hoist ring, as is disclosed in Fuller, the center-pull hoist ring disclosed in Schron Jr. provides rotation about a first and a second axis which are perpendicular to one another. This allows the load bearing ring to automatically pivotally extend towards the direction of the applied force. However, with center-pull style hoist rings, the first and second axes intersect one another, which is not the case with side-pull a hoist rings as is disclosed in Fuller. Schron Jr. is also incorporated by reference as background information.

BACKGROUND OF THE INVENTION

It is well known in the art that by securing a load ring to an object, the load ring can be utilized to lift the object or to secure the object. In this respect, a hook attached to a hoisting device may be utilized to lift heavy objects such as molds and die sets by interengaging with the hoist ring. In addition, straps or tie downs can be attached to the ring to secure an object during shipment. Earlier load bearing rings utilized rigid ring mechanisms fixedly attached to the load member. The common attaching method is by directly threading the load ring into a threaded bore on the surface of the load member. This design is simple but has many problems in that by directly threading the rigid load ring to the surface of the object, the load ring may loosen, which would require subsequent tightening thereof. In addition, since the load ring is fixedly engaged to the load member, it is not capable of automatically pivotally extending toward the direction of the applied force. Therefore, a bending moment is produced in the direction of the applied force when the lifting device applies the force to the load member. The bending moment requires stronger materials to be utilized or additional reinforcement of the load ring. In addition, large loads can damage the threads of the threaded bore. In order to overcome the shortcomings of the rigid ring, hoist rings which allow the load bearing ring to pivot toward the direction of the applied force were developed. However, providing a structure that allows pivotal movement of the load ring disadvantageously increases the cost of the hoist ring device. In this respect, allowing pivotal movement of the load ring about one or two axes increases the number of components in the hoist ring and further increases the complexity of the manufacturing process.

Another disadvantage found in the prior art is that in order to allow the load bearing ring to pivot to the direction of the applied force, intricate components are required, which further add to the expense of the manufacturing process. Further, in order to produce a pivotable hoist ring that acts as a single component in both the mounted and unmounted condition, complicated support members are required to handle the applied force and to prevent inadvertent disassembly when the device is removed from the load member while still allowing for pivotal movement about two axes. In addition, due to the substantial forces created by the applied force, high strength materials are utilized for the support member which typically do not possess properties favorable for machining. This further adds to the cost of the hoist ring device.

SUMMARY OF THE INVENTION

In accordance with the present invention, an improved hoist ring is provided which requires fewer components and fewer machining steps while still providing a rigid hoist ring with a load bearing ring capable of pivoting automatically in the direction of the applied force during the lifting or securing procedure. More particularly, a hoist ring in accordance with the present invention includes a support member which allows a post, which fixedly engages the threaded bore of a load member, to also partially interengage with a load bearing ring to retain the load bearing ring in the support member, while still allowing pivotal movement of the load bearing ring about two axes. In providing a support member in accordance with the present invention, the number of components and the number of machining steps are advantageously reduced even though the strength of the hoist ring is maintained and the components of the hoist ring are retained by the support member even when the hoist ring is removed from the load member. In addition, by providing a support member which is a unified component, strength is increased while the number of component parts is reduced.

The foregoing advantages are achieved in accordance with the present invention by utilizing a support member having a passage for receiving the post which partially intersects with a ring slot that is generally perpendicular to the passage such that a portion of the post, when it is received in the passage, interengages with the load ring in the ring slot to retain the load ring in the ring slot. Further, the interengagement between the portion of the post and the load ring does not reduce the ability of the load ring to freely pivot within the slot or the support member to freely pivot about the post.

It is accordingly an outstanding object of the present invention to provide a hoist ring which pivotally interengages with a load member to allow the load bearing ring to automatically adjust to the direction of the applied force during the lifting or securing procedure.

Another object is the provision of a hoist ring of the foregoing character which requires fewer components and fewer manufacturing steps than hoist rings heretofore available.

A further object is the provision of a hoist ring of the foregoing character which is less expensive to produce while maintaining its structural integrity.

Still another object of the present invention is the provision of a hoist ring of the foregoing character which is joined together in such a way that the components thereof are retained therein even when the hoist ring is removed from the load member.

Yet another object of the present invention is the provision of a hoist ring of the foregoing character which utilizes a unified central support member which provides rotation of the load ring about two axes.

A further object of the present invention is the provision of a hoist ring of the foregoing character which is easy to use.

BRIEF DESCRIPTION OF THE DRAWINGS

The foregoing and other objects and advantages will become apparent from the following description taken together with the accompanied drawings in which:

FIG. 3 is a cross-sectional elevation view taken along line 3—3 of FIG. 1;

FIG. 4 is a rear elevation view of the hoist ring in FIG. 1; and

FIG. 5 is a cross-sectional elevation view taken along line 5—5 of FIG. 2.

DESCRIPTION OF A PREFERRED EMBODIMENT

Figure 1:
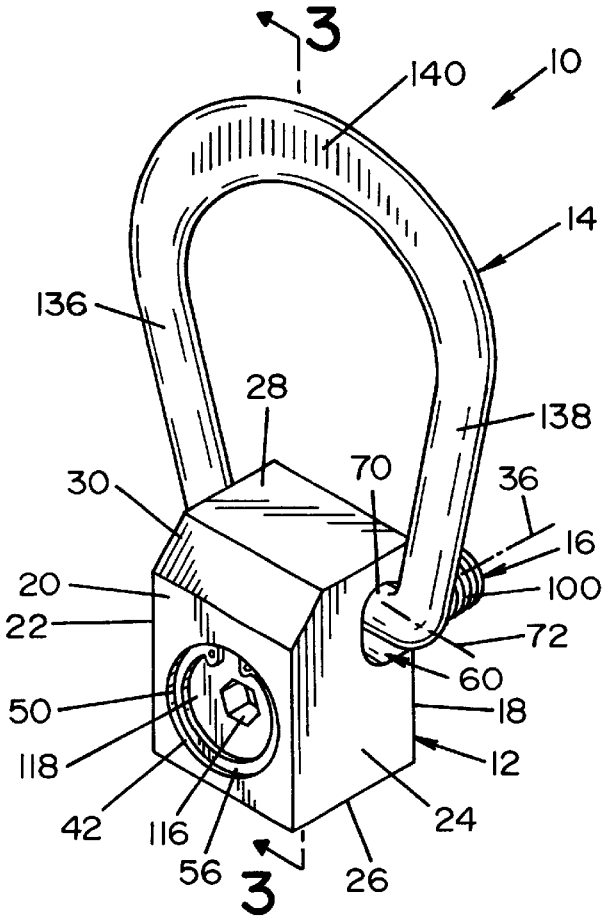
FIG. 1 is a perspective view of a hoist ring in accordance with the present invention.
Figure 2:
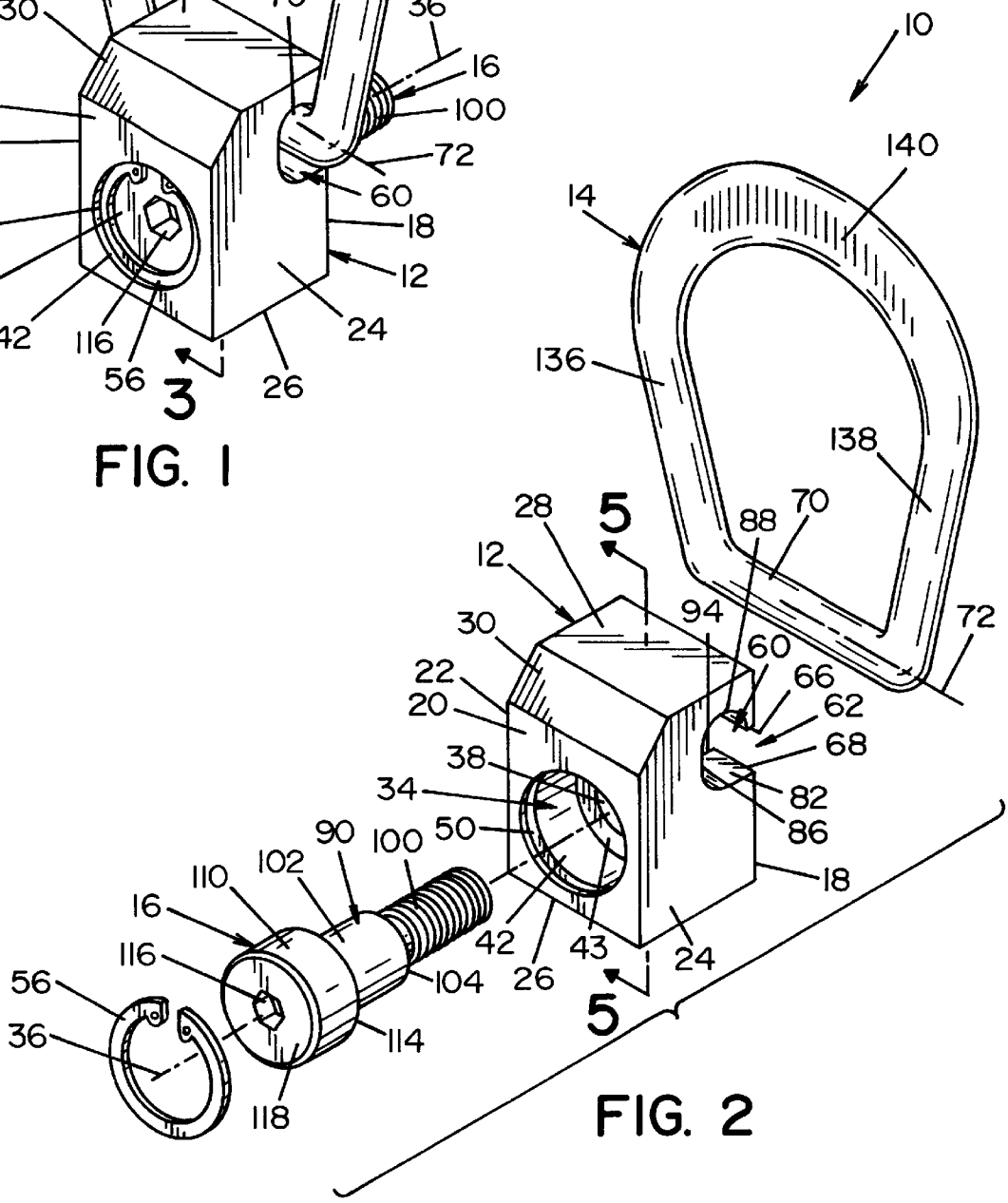
FIG. 2 is an exploded perspective view of the hoist ring in FIG. 1.

Referring now in greater detail to the drawings, wherein the showings are for the purpose of illustrating a preferred embodiment of the present invention only, and not for the purpose of limiting the same, FIGS. 1–5 show a side-pull hoist ring 10 which primarily includes only three components, namely a support member 12, a load bearing ring 14 and a post 16. Support member 12 can be configured in many shapes, but is shown as a generally rectangular block mountable on a load member 32 and, relative thereto, having an inwardly facing surface 18, an outwardly facing surface 20, side surfaces 22 and 24, a bottom facing surface 26 and a top facing surface 28. Support member 12 can further include an inclined surface 30 between top surface 28 and outwardly facing surface 20. Support member 12 should be constructed of high strength steel to withstand the forces involved when hoist ring 10 is utilized to support load member 32.

Support member 12 further includes a passage 34 having a first axis 36. Passage 34 is shaped to receive post 16 and to allow post 16 to rotate relative to support member 12 about axis 36.

Passage 34 extends from inwardly facing surface 18 to outwardly facing surface 20 and includes a first cylindrical portion 38 extending inwardly from surface 18 and having a first diameter 40 and a second cylindrical portion 42 extending from first cylindrical portion 38 to outwardly facing surface 20. Second cylindrical portion 42 has a second diameter 44 which is greater than first diameter 40, thus providing a shoulder 43 between the passage portions. First cylindrical portion 38 and second cylindrical portion 42 have lengths 46 and 48 respectively in the direction of axis 36. Second cylindrical portion 42 further includes a clip retaining groove 50 coaxial with axis 36 which supports a split spring clip 56 in the manner and for the purpose discussed in greater detail below.

Support member 12 also includes a ring slot 60 extending from side surface 22 to side surface 24 and transverse to axis 36. Ring slot 60 has a generally L-shaped cross-sectional configuration with an elongated slot opening 62 between side surfaces 22 and 24 at inwardly facing surface 18. Further, slot opening 62 is defined by an upper slot edge 66 and a lower slot edge 68 which are spaced apart to receive a pivot leg 70 of load bearing ring 14 as set forth more fully hereinafter. Preferably, leg 70 is substantially cylindrical, has a given diameter, and has an axis 72 which is transverse to first axis 36 when leg 70 is in ring slot 60. Ring slot 60 further includes a slot surface which extends from lower slot edge 68 to upper slot edge 66 and includes, starting at lower slot edge 68, a bottom surface 82 extending inwardly from edge 68 toward outwardly facing surface 20, an inner surface 86 at the inner end of surface 82 extending upwardly toward top facing surface 28, and downwardly open arcuate upper slot surface 88 which has a radius corresponding to the radius of leg 70 of load bearing ring 14. Arcuate slot surface 88 terminates along upper slot edge 66 and has an axis between side surfaces 22 and 24 which coincides with axis 72 when ring leg 70 engages surface 88 as shown in FIG. 3.

As mentioned above, ring slot 60 is perpendicular to passage 34 which provides for the full range of pivotal movement of load bearing ring 14 about axes 36 and 72, thereby allowing load bearing ring 14 to automatically adjust to the direction of the applied force. The pivotal movement of load bearing ring 14 will be discussed in greater detail below. Ring slot 60 intersects with passage 34 to form an intersecting opening 94 therebetween. Passage 34 is centered between side surfaces 22 and 24, whereby opening 94 is centered in ring slot 60 between side surfaces 22 and 24 and intersects bottom surface 82 and the lower part of inner surface 86 of the ring slot 60.

Post 16 comprises a cylindrical stem 90 having a threaded outer end portion 100 adjacent an unthreaded inner portion 102 intersecting threaded portion 100 along a circumferential edge 104.

Threaded portion 100 has a thread diameter which is smaller than that of unthreaded portion 102.

Post 16 further includes a head 110 at the inner end of stem portion 102 having a head diameter which is greater than the diameter of stem portion 102, thus providing a shoulder 114 between head 110 and stem portion 102. In order for post 16 to freely pivot in passage 34 relative to support member 12, it is preferred that both stem portion 102 and head 110 be cylindrical and coaxial with axis 36. To facilitate the rotation of post 16 about axis 36 by the user for introducing the post into a threaded bore 115 of load member 32, head 110 preferably includes a tool receiving recess 116. Preferably, tool receiving recess 116 is a hex key recess in outer head surface 118, even though other tool receiving contours may be utilized.

Load bearing ring 14 can be configured in any known loop configuration and can be either a unified structural component or can be comprised of multiple components. Shown is a standard unified single hoop configuration which incorporates the pivot leg 70 having a length 130. The diameter of leg 70 must be smaller than the distance between edges 66 and 68 of ring slot opening 62 to allow entry of leg 70 into ring slot 60. Further, the length 130 of leg 70 must be greater than the width of support member 12 between side surfaces 22 and 24 to allow load ring 14 to pivot 360° about axis 72 of leg 70. In this respect, by having the length of leg 70 greater than the width of support member 12, side legs 136 and 138 of load ring 14 will clear side surfaces 22 and 24 of support member 12. Legs 136 and 138 diverge from leg 70 and are joined by an upper curved leg 140. Even though other ring configurations can be utilized, it is preferred that upper leg 140 be curved so that the force applied to load ring 14 will be aligned in the center of the load ring 14, thereby balancing the load about the center of hoist ring 10.

Hoist ring 10 is assembled in the following manner. First, pivot leg 70 of load ring 14 is received in ring slot 60 through opening 62 such that load ring 14 can pivot relative to support member 12 about axis 72 which, as described hereinabove, is substantially perpendicular to axis 36. Once load ring leg 70 is received in ring slot 60, post 16 is positioned in passage 34 such that shoulder 114 engages against shoulder 43 to position stem portion 102 in first cylindrical passage portion 38 and head 110 in second passage portion 42. Post 16 is axially retained within passage 34 by fitting split spring clip 56 into clip retaining groove 50. Once clip 56 is received in clip groove 50, post 16 is axially retained in passage 34 by the engagement between ring clip 56 and head surface 118. It should be noted that other methods known in the art to maintain post 16 in passage 34 can be utilized. First cylindrical passage portion 38 is sized to receive unthreaded stem portion 102 and to allow the rotation of stem portion 102 within passage portion 38. The same is true with second passage portion 42 wherein its diameter is sized to allow head 110 to rotate therein. When post 16 is received in passage 34, stem portion 102 engages passage portion 38 and extends through intersecting opening 94, thereby entering into the lower portion of ring slot 60 and projecting above bottom surface 82 thereof The latter projection, as will be appreciated from FIGS. 3 and 4, retains pivot leg 70 within ring slot 60 against displacement outwardly through slot opening 62. While post 16 maintains load ring 14 in ring slot 60 in this manner, load ring 14 is still capable of freely rotating about axis 72 of leg 70.

Hoist ring 10 is secured to load member 32 by threading post 16 into a threaded bore 115 in load surface 152 until edge 104 of stem portion 102 interengages with load surface 152. Stem portion 102 has a length which is greater than the length of passage portion 38 when shoulder 114 of head 110 engages shoulder 43, whereby edge 104 of stem portion 102 extends out of passage 34 beyond inwardly facing surface 18 of support member 12 such that there is a gap 155 between inwardly facing surface 18 and load surface 152. This allows post 16 to be rigidly secured to load member 32 while still allowing support member 12 and load ring 14 to freely pivot about post 16. By utilizing a split ring style clip 56, tool receiving recess 116 can be easily accessed when post 16 is locked in passage 34. Simultaneously allowing the rotation of support member 12 and load ring 14 about axis 36 and the rotation of load ring 14 about leg axis 72 enables load ring 14 to freely and automatically adjust relative to load member 32 in the direction of the applied force.

While considerable emphasis has been placed on a preferred embodiment of the invention illustrated and described herein, it will be appreciated that other embodiments can be made and that many changes can be made in the preferred embodiment without departing from the principles of the invention. Accordingly, it is to be distinctly understood that the foregoing descriptive matter is to be interpreted merely as illustrative of the invention and not as a limitation.

Having thus described the invention, it is claimed:

1. A hoist ring for mounting on a load member, said hoist ring comprising: a load bearing ring; a support member including a passage having a first axis and a load ring slot having a slot axis generally perpendicular to said first axis, said slot intersecting said passage and supporting said load ring for rotation relative to said support member about said slot axis; a post extending through said passage and having an outer end for mounting said hoist ring on the load member and having a portion in said passage interengaging with said load ring to retain said load ring in said ring slot.

2. The hoist ring as defined in claim 1, wherein said support member includes an inwardly facing surface and an opposing outwardly facing surface with side surfaces connecting said inwardly and outwardly facing surfaces; said ring slot extending between said side surfaces and having an elongated slot opening in said inwardly facing surface extending between said side surfaces for receiving said load ring when said post is removed from said passage.

3. The hoist ring as defined in claim 2, further including a clip for axially retaining said post in said passage.

4. The hoist ring as defined in claim 3, wherein said portion of said post in said passage includes an edge spaced outwardly adjacent said support member for engaging the load member on which said hoist ring is mounted.

5. The hoist ring as defined in claim 4, wherein said passage includes a first and a second cylindrical portion and said post further includes a head, said first cylindrical portion having a first diameter and extending from said inwardly facing surface toward said outwardly facing surface, said second cylindrical portion being adjacent said first cylindrical portion and having a second diameter greater than said first diameter; said first cylindrical portion receiving said portion of said post in said passage and said second cylindrical portion receiving said head, said clip being between said head and said outwardly facing surface of said support member.

6. The hoist ring as defined in claim 5, wherein said head includes a tool receiving contour for rotating said post relative to said support member while in said passage.

7. The hoist ring as defined in claim 6, wherein said tool receiving contour is a hex key recess and said clip is an internal retaining clip nested in a clip groove in said second cylindrical portion.

8. The hoist ring as defined in claim 1, wherein said support member includes an inwardly facing surface and an opposing outwardly facing surface with side surfaces connecting said inwardly and outwardly facing surfaces; said ring slot extending between said side surfaces and having a bottom slot surface partially intersecting said passage, said ring slot furtherer including a downwardly opened upper slot surface opposite said bottom slot surface and extending toward said inwardly facing surface, said upper slot surface forming a retaining flange adjacent said inwardly facing surface, said flange and said portion of said post retaining said load ring in said ring slot.

9. The hoist ring as defined in claim 8, further including a clip for axially retaining said post in said passage.

10. The hoist ring as defined in claim 9, wherein said portion of said post in said passage includes an edge spaced outwardly adjacent said support member for engaging the load member on which said hoist ring is mounted.

11. The hoist ring as defined in claim 10, wherein said passage includes a first and a second cylindrical portion and said post further includes a head, said first cylindrical portion having a first diameter and extending from said inwardly facing surface toward said outwardly facing surface, said second cylindrical portion being adjacent said first cylindrical portion and having a second diameter greater than said first diameter; said first cylindrical portion receiving said portion of said post in said passage and said second cylindrical portion receiving said head, said clip being between said head and said outwardly facing surface of said support member.

12. The hoist ring as defined in claim 11, wherein said head portion includes a tool receiving contour for rotating said post relative to said support member while in said passage.

13. The hoist ring as defined in claim 12, wherein said tool receiving contour is a hex key recess and said clip is an internal retaining clip nested in a clip groove in said second cylindrical portion.

14. The hoist ring as defined in claim 1, further including a clip for axially retaining said post in said passage.

15. The hoist ring as defined in claim 1, wherein said support member includes an inwardly facing surface and an opposing outwardly facing surface with side surfaces connecting said inwardly and outwardly facing surfaces; said ring slot extending between said side surfaces and having an elongated slot opening in said inwardly facing surface extending between said side surfaces, said slot opening having a width large enough to receive said load ring, said portion of said post partially reducing said slot width when said post is received in said passage.

16. The hoist ring as defined in claim 15, wherein said ring slot has a substantially L-shaped cross-sectional configuration.

17. The hoist ring as defined in claim 16, wherein one leg of said L-shaped configuration includes an arcuate surface portion and the other leg includes said ring slot.

18. The hoist ring as defined in claim 17, wherein said arcuate surface portion of said one leg is a downwardly opened upper slot surface.

* * * * *